US009751673B2

(12) United States Patent
Chang

(10) Patent No.: US 9,751,673 B2
(45) Date of Patent: Sep. 5, 2017

(54) SEPARATED COMPARTMENT LUBRICATION PACKAGE

(71) Applicant: Herman Chang, Rancho Dominguez, CA (US)

(72) Inventor: Herman Chang, Rancho Dominguez, CA (US)

(73) Assignee: Herman Chang, Rancho Dominguez, CA (US)

( * ) Notice: Subject to any disclaimer, the term of this patent is extended or adjusted under 35 U.S.C. 154(b) by 0 days.

(21) Appl. No.: 14/471,662

(22) Filed: Aug. 28, 2014

(65) Prior Publication Data

US 2014/0367298 A1 Dec. 18, 2014

Related U.S. Application Data

(63) Continuation-in-part of application No. 13/725,672, filed on Dec. 21, 2012, now Pat. No. 9,239,132.

(51) Int. Cl.
*B02C 23/18* (2006.01)
*B65D 75/30* (2006.01)
*B02C 18/16* (2006.01)

(52) U.S. Cl.
CPC ..... *B65D 75/30* (2013.01); *B02C 2018/166* (2013.01)

(58) Field of Classification Search
CPC ..... B65D 75/30
USPC ..... 184/13.1
See application file for complete search history.

(56) References Cited

U.S. PATENT DOCUMENTS 2,595,708 A * 5/1952 Kopald ..... B65D 75/30 206/484.1
3,472,675 A * 10/1969 Himmel ..... A61K 9/007 15/104.93
3,652,174 A * 3/1972 Boone ..... A47K 5/04 118/325
4,515,703 A * 5/1985 Haq ..... A47L 13/17 15/104.93
5,226,199 A * 7/1993 Jacoby ..... B60S 1/0486 15/246
5,494,229 A * 2/1996 Rokos ..... B02C 18/0007 184/6.1
5,875,719 A * 3/1999 Francis ..... G09F 3/10 101/424
6,315,482 B1 * 11/2001 Girardot ..... A45D 40/00 15/104.93

(Continued)

FOREIGN PATENT DOCUMENTS

DE 3426979 A1 1/1986
DE 8702207 U1 6/1987

*Primary Examiner* — Michael Riegelman
(74) *Attorney, Agent, or Firm* — Stefan J. Kirchanski; Zuber, Lawler & Del Duca, LLP

(57) ABSTRACT

A lubrication package for lubrication of paper shredders wherein a lubricant is sandwiched between two coversheets which are sealed together near their peripheral edges to contain the lubricant. When the package is inserted into an operating paper shredder, the coversheets are shredded and release the lubricant to lubricate the shredding mechanism. The lubricant is prevented from all migrating towards one of the peripheral edges by interior seals that divide the package into at least two interior regions that do not contact sealed together peripheral edges of the package.

3 Claims, 6 Drawing Sheets

(56) References Cited

U.S. PATENT DOCUMENTS

| | | | | |
|---|---|---|---|---|
| 7,166,561 | B2 * | 1/2007 | Allen | B02C 18/0007 162/117 |
| 7,387,270 | B2 | 6/2008 | Wang | |
| 7,793,876 | B2 | 9/2010 | Wang | |
| 7,902,129 | B2 * | 3/2011 | Allen | B02C 18/0007 184/109 |
| 8,066,444 | B2 * | 11/2011 | Rippl | A47L 13/17 401/133 |
| 8,708,261 | B2 | 4/2014 | Allen | |
| 9,239,132 | B1 * | 1/2016 | Wang | F16N 25/00 |
| 2006/0169619 | A1 | 8/2006 | Wang | |
| 2006/0243631 | A1 | 11/2006 | Duke | |
| 2007/0080252 | A1 | 4/2007 | Pierce et al. | |

* cited by examiner

SEPARATED COMPARTMENT LUBRICATION PACKAGE

CROSS-REFERENCE TO PRIOR APPLICATIONS

This application is a continuation in part of U.S. patent application Ser. No. 13/725,672 filed on 21 Dec. 2012.

U.S. GOVERNMENT SUPPORT

Not Applicable

BACKGROUND OF THE INVENTION

Field of the Invention

This invention relates to a paper shredder, particularly to a lubricating packet designed to be shredded by a paper shredders to provide lubrication to the cutting blades of the paper shredder.

Description of the Background

Paper shredders are common appliances that are used to render paper documents unreadable to prevent theft of private information such as financial information. It is relatively simple for someone to rifle through another's trash to discover account numbers and other data that can be used to perpetrate identity theft. Therefore, virtually all businesses and many private individuals shred any documents that contain private information. With a paper shredder papers are generally introduced through a slot or chute into a shredding mechanism. Most paper shredders employ a plurality of cutting blades spaced apart along counter rotating shafts as shredding mechanisms. A nip (i.e., regions where blades from opposite shafts overlap or closely approach each other) is formed between two such blade-bearing shafts, and sheets of paper inserted into the nip are sheared into fragments.

Shredders can be generally classed into two broad types according to the shape of the fragments they produce. In the simplest type of shredder, the strip-cut shredder, the cutting blades on the rotating shafts cut the paper only in a longitudinal direction to form strips. While fairly difficult, it is possible to reassemble the strips to "recover" the original document and thus read the confidential information thereon. Most newer shredder are "cross cut" shredders that have blades that include more than one cutting edge per blade with these extra cutting edges disposed on the shaft to first cut the paper along a longitudinal direction into strips and to then cut the strips at an angle to the longitudinal direction to cut the strips into paper chips. These shredders produce a product of mostly rectangular or diamond shaped fragments not unlike confetti from which it is virtually impossible to reassemble the original document. A sub-type of the "cross-cut" shredder is the "micro-cut" shredder which produces tiny paper fragments not much larger than a grain of rice. Such fragments are even more difficult to reassemble so that "micro-cut" shredders are required for high security information in government operations, etc.

Unfortunately, the blades of the shredder—particularly the cross-cut shredder—become heated in use from mechanical friction and bind dust and debris resulting from the shredding process. Furthermore, depending on air quality and humidity levels the blades may begin to corrode with time. These processes gradually reduce the efficiency of the shredders and may ultimately cause them to fail. One way of avoiding this problem is to apply a lubricant such as oil to the cutting mechanism. However, it is relatively difficult to directly apply a lubricant—particularly a liquid one—to the rotating blades. Because of safety concerns the blades are usually sealed within the system and not readily accessible—making application even more difficult. Attempting to pour oil down the inlet slot or chute of an operating shredder is messy and may result in lubricant being sprayed back on the user—or worse such as ignition of flammable lubricant by heated shredder components.

The prior art solution to this problem is to enclose the lubricant in some sort of package. For example, patent applications to Zettler (DE 8702207) and to Holland (DE 3426979) contemplate enclosing a lubricant-bearing sheet, such as oil-soaked paper, in oil-resistant cover layers. Such a compound sheet or lubrication package can be easily and cleanly handled and inserted into an operating shredder to lubricate the shredder blades which readily cuts the compound sheet into lubricant-soaked fragments which contact and lubricate the mechanism. These prior art references also contemplate sealing a liquid lubricant such as oil directly between oil-resistant cover layers and dispensing entirely with the lubricant-bearing sheet. In attempting to commercialize these prior art designs, it was discovered that an unanticipated problem was that as the lubrication package was drawn into the shredding mechanism, it became compressed resulting in the release of a puff of air containing oil droplets. These droplets could squirt out of the machine and/or deposit oil in regions of the shredder that should not receive oil. This problem is more severe in the liquid oil designs where no lubrication substrate is used.

One solution to this problem is shown in U.S. Pat. No. 7,793,876 which discloses a plurality of vents arranged peripherally around the edges of the lubrication package between two spaced apart, parallel peripheral seals. Because of the arrangement of peripheral seals, the lubricant is retained within the lubrication package until it is compressed during the shredding process. At that time, the vents relieve built up pressure and direct the compressed air and any oil droplets into the shredding mechanisms. The system works particularly well with substrate-free designs so that such designs have become preferred. However, there is another unanticipated problem with many such designs.

In a substrate-free lubrication package, the liquid oil may redistribute within the sealed package in response to gravity. If the sheets are stored flat with their surfaces more or less parallel to the surface of the Earth, there is no problem. However, if the sheets are stored with their surfaces perpendicular to the surface of the Earth, the oil may pool at the lower edge of the package. Depending on the storage orientation of the packages, this can result in regions of the shredder blades not receiving sufficient lubricant. For example, if the oil is pooled along the left-hand edge of the lubrication sheet, the shredder blades towards the right-hand edge of the mechanism may not be properly lubricated. This problem can be avoided by a plurality of interior seals extending from one peripheral edge of the lubrication sheet to the opposite edge so as to divide the interior area of the package into four or more sub-cavities or regions. The interior seals prevent edge pooling of the lubricant in response to gravity. Instead of moving to the lowest edge, part of the lubricant is stopped near the center of the package by the interior seal, thereby ensuring more even distribution of the lubricant. At least one edge of each sub-cavity is in contact with a row of vent holes for limiting the problem of lubricant compression. However, providing vent holes is an additional manufacturing step and may even lead to leakage of lubricant from the sheets prior to their use in the paper shredder. It would be advantageous to solve the lubricant redistribution problem without the necessity of vent holes.

SUMMARY OF THE INVENTION

It has been discovered that an even better way of preventing the problems of lubricant pooling is to use interior seals to divide the sheet into interior regions while ensuring that none of the interior seals reach from one peripheral edge of the sheet to the other. It is apparent that by having a number of interior regions, the lubricant can prevented from pooling at one edge of the sheet, thereby ensuring even lubrication. However, another surprising benefit of this arrangement is that the problem of lubricant compression and squirting is significant reduced or eliminated with no need to provide vent holes. This simplifies manufacture of the lubrication sheet.

DETAILED DESCRIPTION OF THE INVENTION

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide an improved design for substrate-free lubrication packages that ensure even distribution of the lubricant and do not require the use of vent holes.

Figure 1:
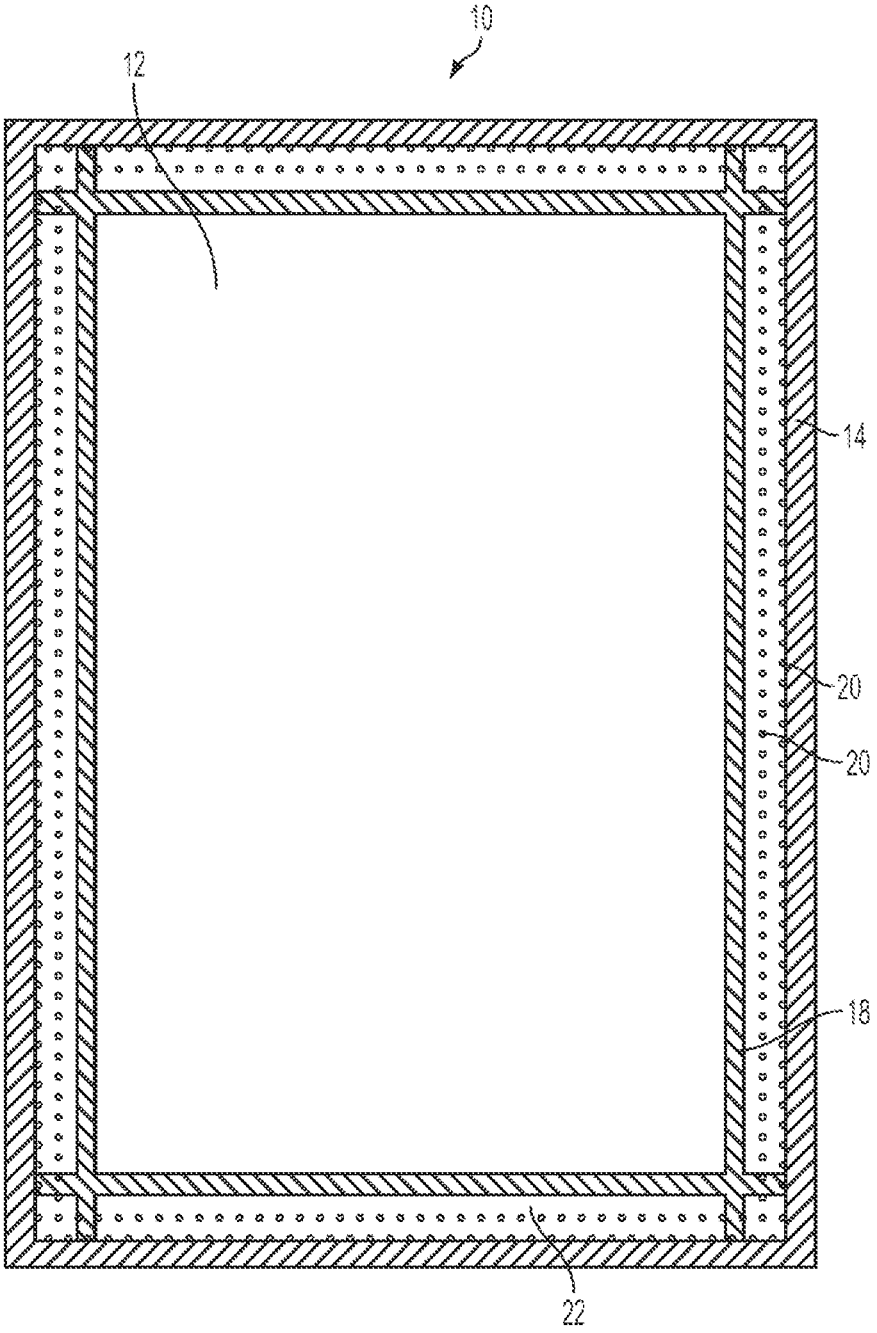
FIG. 1 PRIOR ART
FIG. 1 is a drawing of a surface view of a prior art lubrication package.
Figure 2:
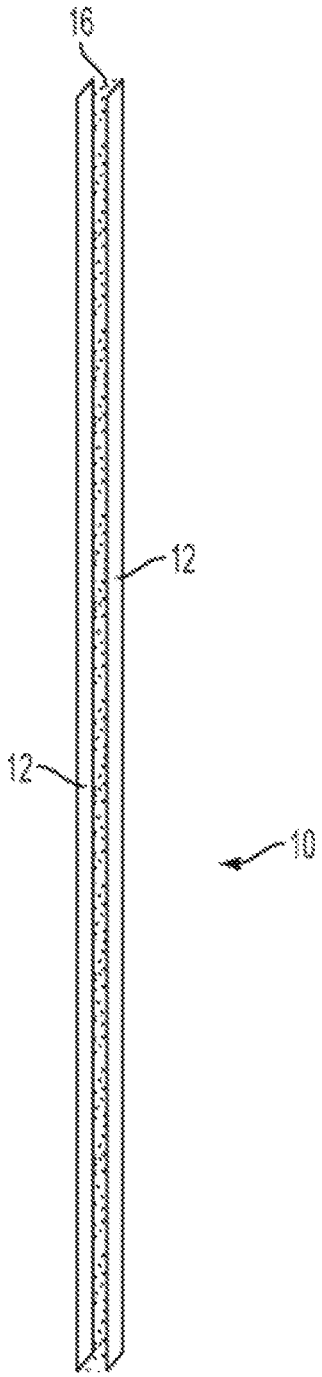
FIG. 2 PRIOR ART
FIG. 2 is a cross-section view of the lubrication package to show the lubricant sandwiched between the impervious sheets.

FIG. 1 shows a surface view of a prior art lubrication package as disclosed in U.S. Pat. No. 7,793,876. The lubrication package 10 is formed from two cover layers 12 (only one of which can be seen in this view) laminated together at an outer peripheral seal 14 (in the figure the cross-hatched region represents the seal where the two cover layers are sealed together). FIG. 2 is a cross-section of the lubrication package 10, and the cavity or space between the two cover layers 12 is filled with lubricant in the form of liquid oil 16. Generally, the cavity or space is quite thin and has been exaggerated in the drawing for sake of clarity. Any lubricating oil of mineral, animal or vegetable origin can be used. Preferably, the oil will be colorless and non-toxic. As shown in FIG. 1, an inner peripheral seal 18 is spaced apart (by about 1 cm) from the outer peripheral seal 14 thereby preventing the oil-filled cavity or space from extending entirely from edge to edge. The peripheral seals 14, 18 are essentially identical and are formed by a heat-sealing tool that simultaneously forms the two parallel seals. Other welding processes such as ultrasonic welding or use of adhesives could also be used to form the seals. A single or (as here) a double row of vent holes 20 are punched through both cover layers in the peripheral region 22 between the two peripheral seals 14, 18.

When this lubrication package 10 is fed through the shredding mechanism of a paper shredder, the enclosed oil 16 and any entrapped air may become pressurized as the sheet is squeezed. When this happens, the air and oil are able to force their way past the inner seal 18 which is not particularly strong. If the vent holes 20 were not present, the air and oil could also force their way past the outer peripheral seal 14 and spurt out along the edge of the lubrication package 10 possibly exiting the shredder or striking some part of the mechanism that should not be lubricated. However, with the vent holes 20 present the oil and air exit the vent holes 20 and coat the rotating blades. As explained above, a potential problem with such a lubrication package is a tendency for the lubricant to pool and become unevenly distributed in response to gravity.

Figure 3:
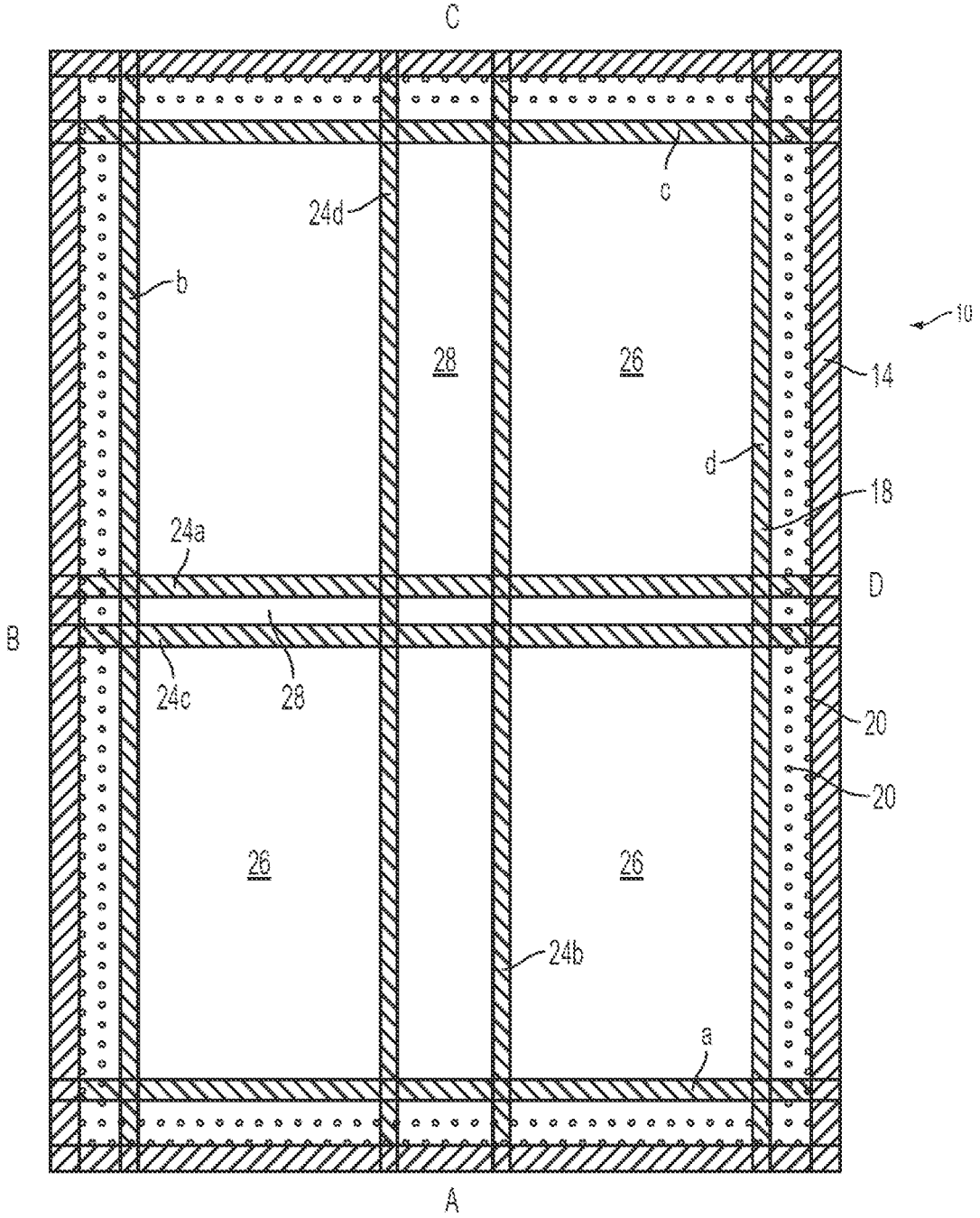
FIG. 3 is surface view of a prior art lubrication package wherein interior regions are formed by interior seals that extend from one peripheral edge to an opposite peripheral edge and vent holes are used to avoid squirting lubricant.

FIG. 3 shows an improved prior art lubrication sheet 10' showing a simple but elegant solution to this pooling problem. A plurality of interior seals 24 (formed similarly to the peripheral edge seals 14, 18) are used to divide the interior cavity into four or more sub-cavities or regions 26. In the drawing paired interior seals 24 are shown as having dimensions similar to the peripheral edge seals. The invention would operate if only single (as opposed to spaced apart double) or even multiple seals were used. Nor is it necessary for the interior seals to be parallel to each other. The notion is to prevent the interior cavity from extending the width (or length) of the lubrication package 10' from edge to edge to prevent edge pooling of the lubricant. In the package 10' shown in FIG. 3, the interior is divided into four major sub-cavities or regions 26 as well as five minor sub-cavities 28. This type of division is adequate to ensure essentially even distribution of the lubricant although it is possible to employ a larger or smaller number and different arrangement of sub-cavities.

The operation of this solution is illustrated by the reference signs A, B, C, and D. If the lubrication sheet 10' is stored with "A" representing the lowermost edge, the lubricant will move towards the peripheral seal marked "a." Because of interior seal 24*a* lubricant from the upper half does not move past the center of the sheet thus ensuring improved distribution of the lubricant. Similarly, turning the sheet to make "B," "C" or "D" the lowermost edge causes lubricant to move towards the peripheral seals marked "b," "c" or "d," respectively. This is prevented by interior seals 24*b*, 24*c* or 24*d*, respectively. Thus, the present invention solves both the problem of lubricant spurting and the problem of lubricant pooling near one edge of the lubrication sheet in response to gravity during storage.

The interior seals 24 are most simply implemented by having the seals 24 run approximately parallel to the peripheral seals 14, 18. However, this orientation is not obligate.

The interior seals 24 could be configured to make various angles other than right angles with the peripheral seals 14, 18. Also, it is not required that the interior seals form straight lines as long as they are disposed to prevent migration of a majority of the enclosed lubricant to one of the peripheral seals 18.

Figure 4:
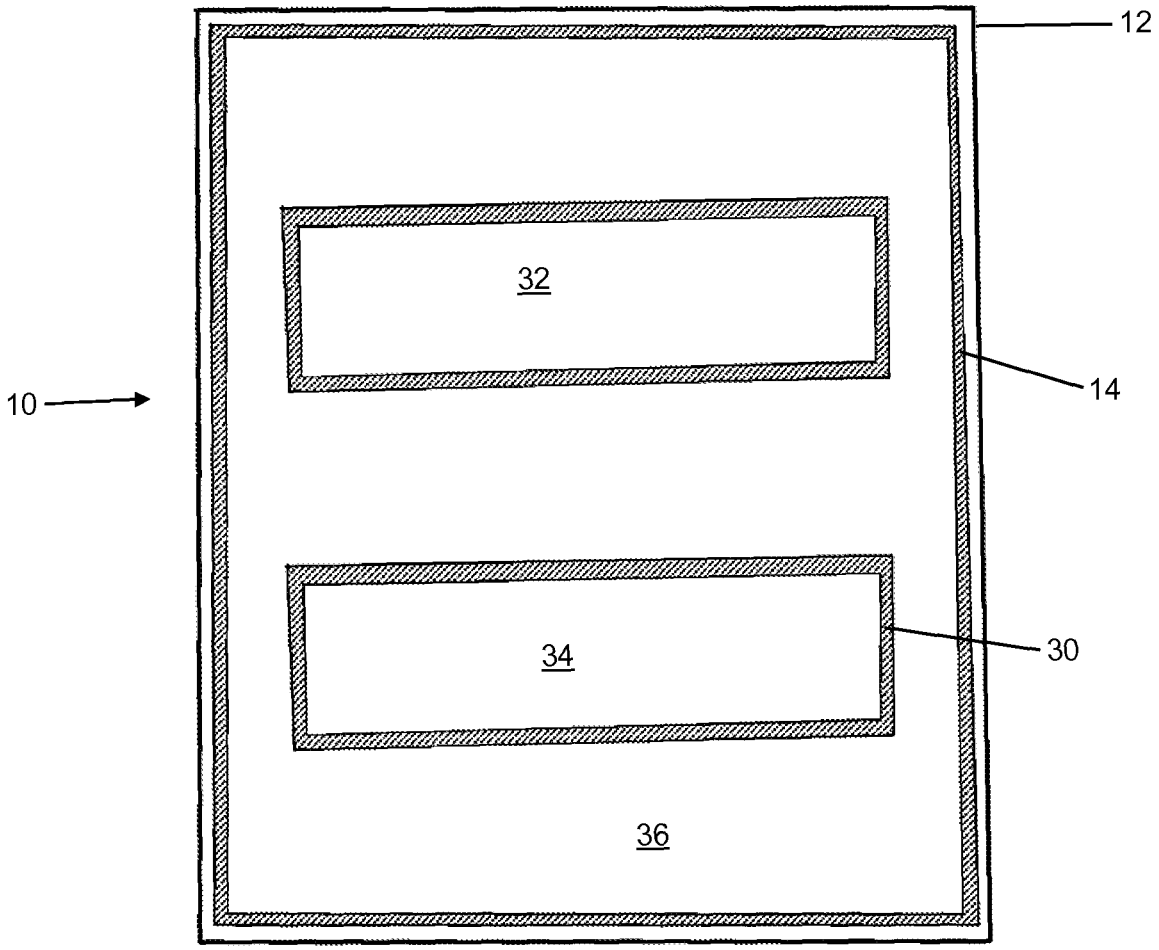
FIG. 4 is a surface view of one embodiment of the present invention wherein the lubrication sheet is divided by interior seals that do not extend from one peripheral edge to an opposite peripheral edge and divide the sheet into two interior regions surrounded by a third region.
Figure 5:
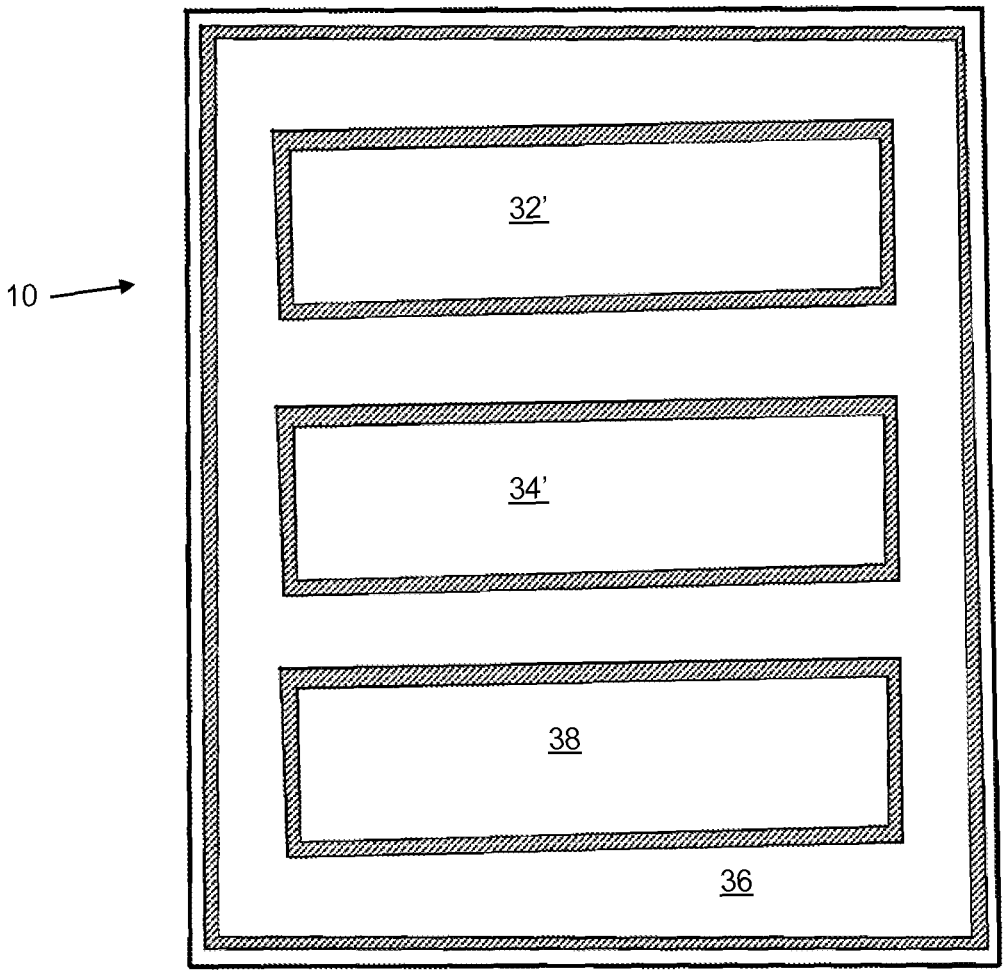
FIG. 5 is a surface view of another embodiment of the present invention wherein the lubrication sheet is divided by interior seals that do not extend from one peripheral edge to an opposite peripheral edge and divide the sheet into three interior regions surrounded by a fourth region.

FIG. 4 shows a first embodiment of the improved lubrication sheet 10 of the present invention. The two layers of oil impervious material 12 (only top sheet shown in drawing) are sealed together near their peripheral edges by an edge seal 14 (in these drawings the patterned area represents the sealed region where the two layers are adhered) as in the prior art device. Interior seals 30 that do not reach the peripheral edges are used to create two interior regions 32, 34 that have no direct contact with the peripheral seal 14. Rather, a small region 36 surrounds the two regions 32, 34 and makes direct contact with the peripheral seal 14. The liquid lubricant can be disposed in all of the regions or just in the interior regions. As shown in FIG. 5, it is also effective to increase the number of interior seals to make three (32', 34' and 38), four (not illustrated) or more independent regions surrounded by small region 36. Because the overall length and area of the various regions are limited, the pressure that develops in the prior art device of FIG. 1 does not develop as strongly so that it is not necessary to employ vent holes as in the prior art device. Of course, including vent holes is acceptable although a double peripheral seal is necessary in that case unless the small surrounding region 36 is free from lubricant and the vent holes are located therein. Note that all the interior regions are shown as being rectangular. This is done only for simplicity of illustration. The interior regions can be of almost any shape, and it is not necessary that the seals forming these regions be parallel to the peripheral edge seals.

Figure 6:
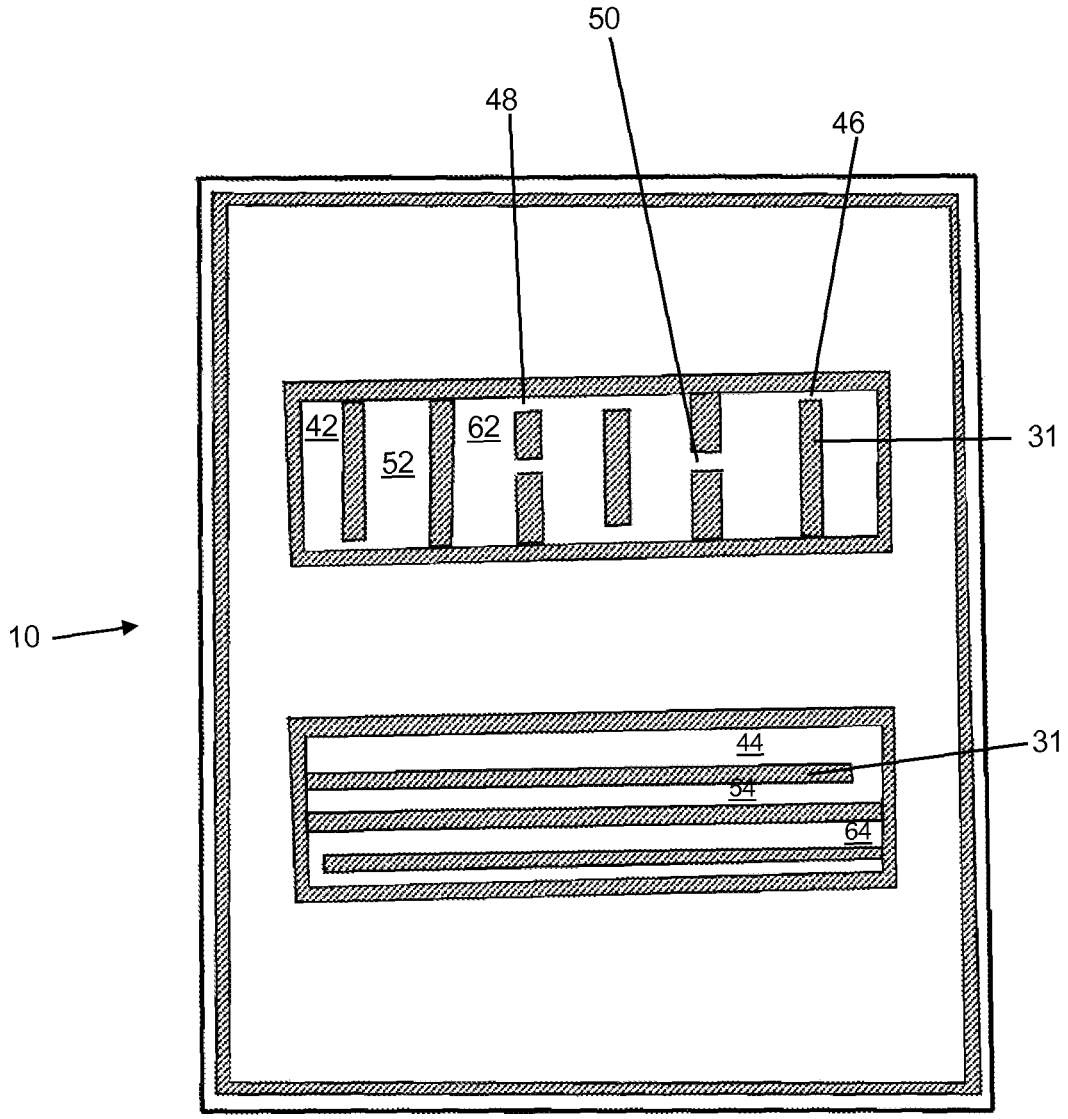
FIG. 6 is a surface view of another embodiment of the present invention wherein the lubrication sheet is divided by interior seals that do not extend from one peripheral edge of the sheet to an opposite peripheral edge and divide the sheet into two interior regions surrounded by a third region where the interior regions are further subdivided by interior seals.

FIG. 6 shows an additional modification that can be made to further ensure even distribution of lubricant. Additional interior seals 31 are provided to subdivide each of the interior regions into sub-regions 42, 52, 62, etc. and 44, 54, 64, etc. In the drawings, some of the additional interior seals 31 contact the interior seals at one end only (see sign 46) or at neither end (see sign 48). Thus, the sub-regions are not actually separated completely from each other. Nevertheless, the additional interior seals 31 are sufficient to impeded migration of the liquid lubricant in response to gravity. It is also possible to have openings through a middle region of the additional interior seals 31 (see sign 50). In either case the openings are sufficiently small that the lubricant is unable to freely migrate in response to gravity. However, when the shredding process pressurizes the lubricant in one region, it is able to redistribute through the openings thereby avoiding buildup of pressure, thereby avoiding the need for vent holes.

It is advantageous to have the interior seals in one interior region not be parallel to the seals in the other region (assuming there are only two interior regions). Thus the sub-regions in one interior region are oriented to avoid pooling of lubricant if the sheets are stored in one orientation whereas the sub-regions in the other interior region are oriented to avoid pooling of lubricant if the sheets are stored in an orientation perpendicular to the first orientation. In fact, it does not matter in what orientation the sheets are stored since at least one area of the sheet will resist pooling and ensure even lubrication of the shredding mechanism. It will be appreciated that the additional interior seals do not necessarily have to be parallel to each other or even straight, for that matter.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A lubrication package to be shredded by a paper shredder so as to lubricate the paper shredder, said package comprising:

two juxtaposed cover layers having peripheral edges;

a peripheral seal bonding the peripheral edges of the two cover layers together;

a lubricant disposed in a space between the two bonded cover layers; and inner seals spaced apart from the peripheral seal, said inner seals not in contact with the peripheral seal or in contact with or continuous with any seals in contact with the peripheral seal, to separate the space into at least two interior regions not in contact with the peripheral seal and one peripheral region in contact with the peripheral seal, wherein the inner seals do not contact the peripheral seal.

2. The lubrication package according to claim 1 comprising two interior regions.

3. The lubrication package according to claim 1 comprising at least three interior regions.

* * * * *